US007299865B1

(12) United States Patent
Kocher

(10) Patent No.: US 7,299,865 B1
(45) Date of Patent: Nov. 27, 2007

(54) LIFT-OUT DEVICE FOR PITLESS WELL ADAPTERS

(76) Inventor: Jason Kocher, 325 S. Hokendauqua Dr., Northampton, PA (US) 18067

( * ) Notice: Subject to any disclaimer, the term of this patent is extended or adjusted under 35 U.S.C. 154(b) by 0 days.

(21) Appl. No.: 10/931,557

(22) Filed: Sep. 1, 2004

(51) Int. Cl.
*E21B 19/16* (2006.01)

(52) U.S. Cl. ..... 166/85.2; 166/99

(58) Field of Classification Search ..... None
See application file for complete search history.

(56) References Cited

U.S. PATENT DOCUMENTS

| | | | | |
|---|---|---|---|---|
| 893,319 | A | 7/1908 | Gillespie et al. | |
| 2,278,111 | A | 3/1942 | Kleinpell | |
| 2,594,908 | A | 4/1952 | Gaulke et al. | |
| 2,689,611 | A | 9/1954 | Martinson | |
| 3,467,181 | A | 9/1969 | Maass | |
| 3,875,698 | A * | 4/1975 | Clark | 417/38 |
| 3,976,131 | A * | 8/1976 | Woodford et al. | 166/85.2 |
| 4,586,741 | A | 5/1986 | Muti | |
| 4,687,056 | A | 8/1987 | Doering | |
| 4,864,899 | A | 9/1989 | Morse | |
| 5,152,598 | A | 10/1992 | Schaffer | |
| 5,501,115 | A * | 3/1996 | Kamiyama et al. | 73/865.8 |
| 5,502,625 | A | 3/1996 | Peng | |
| 5,515,250 | A | 5/1996 | Ortega | |
| 5,980,063 | A | 11/1999 | Ford et al. | |
| 5,983,736 | A * | 11/1999 | Gershman | 73/865.8 |
| 6,126,295 | A | 10/2000 | Hillinger | |
| 6,293,172 | B1 | 9/2001 | Smith | |
| 6,318,875 | B1 | 11/2001 | Hrabar et al. | |
| 6,367,944 | B1 | 4/2002 | Wang | |
| 6,379,020 | B1 | 4/2002 | Lewis et al. | |
| 6,478,442 | B2 | 11/2002 | Chen | |
| 6,592,342 | B1 * | 7/2003 | Hanson | 417/423.3 |

* cited by examiner

*Primary Examiner*—Zakiya W. Bates
(74) *Attorney, Agent, or Firm*—Charles A. Wilkinson; Clinton H. Wilkinson

(57) ABSTRACT

A lift-out device for attachment to a pitless adapter in a water well assembly for use when servicing well pumps including a light source mounted near the lower end of the lift-out device for illuminating the interior of a well casing to facilitate attachment of the device to a pitless adapter. Apertures are located in the side of the tubular pipe member adjacent the light source, and a socket for electrically connecting said light source to an external power source such as a rechargeable battery pack is preferably mounted in the handle of the device. The illumination device is preferably cushioned in order to prevent breakage during use and storage.

10 Claims, 3 Drawing Sheets

LIFT-OUT DEVICE FOR PITLESS WELL ADAPTERS

BACKGROUND OF THE INVENTION

1. Field of the Invention

The present invention relates generally to water well systems as well as pitless well pipe adapters, and more particularly to an improved lift-out tool for attachment to a pitless well adapter fitting for raising and lowering said adapter and the submersible water pump connected thereto into and from the well casing, and more particularly still to a lift-out tool for attachment to a pitless well adapter having an integral illumination means for facilitation of the attachment procedure.

2. Background of the Invention

A so-called pitless adapter is a specialized pipe fitting that is secured to a well casing below ground, beneath the frost line. The bottom end of the pitless adapter is connected by piping to a water pump suspended within the well, such that well water pumped upwardly from the well pump through the adapter may be diverted horizontally through a hole in the casing and piped to a house or home or other use, thereby minimizing the risk of frost-frozen pipes. The pitless adapter has an elbow that is connected through the well casing to the water discharge line. A water-tight seal is created between the pitless adapter and the well casing such that the risk of contamination of the water well by external sources leaking through the connection is also minimized.

The pitless adapter is generally a two-piece unit comprising a portion that permanently attaches to the well casing and an adapter body that can be removed from the permanently attached portion during access and removal of the water pump. The permanently attached mechanism has a receiver that allows the adapter body to slide and seal with the attached mechanism for reinstallation of the pump. The pitless adapter body is threaded on its upper side to threadably accept a lift-out device comprised essentially of a threaded fitting on a pipe or rod such that the pipe can be used to lift and lower the pitless adapter body and attached pump to and from the water well, either in performing routine maintenance or replacing such pump with a new pump. Pitless adapters therefore provide a useful means for accessing and servicing parts of a well system, particularly the well pump.

A significant problem arises in manually connecting a lift-out device to the pitless adapter body inside the well casing. Because the pitless adapter is several feet down and substantially inside the well casing, which is itself essentially a deep, dark, narrow hole, it is very difficult to see the threaded connector on the pitless adapter body and to thread the lift-out tool to such adapter body. Common practice is to try to shine a flashlight into the hole while threading the lift pipe into the adapter body, or to use a mirror to try to reflect sunlight down the well casing. This technique fails because the usual flashlight beam can only travel a few feet into the hole before dispersing into darkness, and the mirror also usually does not provide sufficient light and is useful only on sunny days. A flashlight, mirror and similar devices, usually therefore will not illuminate the threads of the adapter sufficiently to be a reliable aid. In addition, it is difficult and cumbersome for a single person to hold a flashlight pointed into the well casing in one hand while steadying the lift pipe and threading it to the adapter body with only the other hand. Thus, threading the pipe into the adapter becomes a hit or miss affair, which is both inconvenient and time consuming, and usually requires two workers, one to hold the flashlight and one to thread the lift-out tool to the adapter.

Thus, a need exists for an improved illuminating device for enabling a worker to more easily attach a lift-out device to a pitless well adapter to remove a water pump from a water well for servicing or the like.

Although all are dissimilar to the present invention, a number of tools in the prior art are known that include a means for illuminating a work area. These include the following:

U.S. Pat. No. 893,319 issued to A. G. Gillespie et al. on Jul. 14, 1908, entitled "Cable Raising or Separating Device," discloses an elongated tool for separating cables such as telephone switchboard cables. A small lamp in the lower end of the device aids workers in seeing between separated cables.

U.S. Pat. No. 2,278,111 issued to G. A. Kleinpell on Mar. 31, 1942, entitled "Tool for Air Pressure Release Bars of Elevator Doors," discloses a tool having an elongated shaft for enabling an elevator operator to release manually the air pressure in an elevator door mechanism. A light source is mounted at the end of the tool to aid an operator in using the tool and illuminating a work area.

U.S. Pat. No. 2,594,908 issued to L. H. Gaulke et al. on Apr. 29, 1952, entitled "Grapple Hook Means," discloses a tool of a well-known type for gripping objects via a plurality of grappling arm elements. A bracket clamp is provided for holding a flashlight such that the flashlight shines on the grappling arm and the work area surrounding the grappling arm.

U.S. Pat. No. 2,706,769 issued to A. Cook on Apr. 19, 1955, entitled "Hand Tool," discloses a screwdriver having a light that illuminates the work area. The light is conveyed through the handle of the screwdriver through transparent plastic.

U.S. Pat. No. 4,348,715 issued to L. R. Christensen et al. on Sep. 7, 1982, entitled "Lighted Tool Holder," discloses a holder having a flashlight-like appearance with a cylindrical adapter mounted to the working end of the holder to which a screwdriver or other tool or device may be temporarily mounted.

U.S. Pat. No. 4,586,741 issued to E. J. Muti on May 6, 1986, entitled "Flashlight Holder," discloses an extension rod for lowering and holding a flashlight down a hole. Although Muti articulates the need to illuminate a distant point in a hole, the technique disclosed in the Muti requires the lowering of two separate shafts into the hole.

U.S. Pat. No. 4,864,899 issued to J. D. Morse on Sep. 12, 1989, entitled "Illuminating Light Bulb Remover," discloses an elongated handheld tool for removing and/or replacing light bulbs to and from overhead light fixtures and having the additional feature of an illumination source mounted near the end of the handle. The bulb is held by a conical member on the end of the tool.

U.S. Pat. No. 5,152,598 issued to G. D. Schaffer on Oct. 6, 1992, entitled "Hole Locator Device," discloses a device to aid in installing ceiling fixtures. The Schaffer invention is comprised of a tapered translucent plastic shank having a base portion with a socket into which a flashlight may be fitted, and a tip with a sharp point and a means for holding an electrical wire. The shank is pushed upwardly into the fixture hole and through the ceiling insulation so that the location of the hole will be immediately evident in the upper adjacent floor or attic. The electrical wire is then secured to the tip of the shank so that when the worker pulls the shank out of the ceiling the wire is also pulled downwardly through the hole.

U.S. Pat. No. 5,502,625 issued to M. Peng on Mar. 26, 1996, entitled "Multipurpose Hand Tool," discloses a combination spanner, screwdriver and illuminator. Although the illuminator is secured within a tube handle in the device, the device is not arranged so that light shines through the tube to illuminate a work area, but rather the combination tools are designed to be used separately.

U.S. Pat. No. 5,515,250 issued to J. A. Ortega on May 7, 1996, entitled "Magnetic Vale Spring Shim Remover," discloses a tool for working on engine valves, and more particularly for removing valve spring shims, which are hard to reach and/or remove. Ortega uses prongs containing magnetic tines so that when the tines physically contact the valve spring shims, the shims are attracted to the magnetic tines and can be easily removed. Ortega discloses an alternative embodiment wherein the handle of the Ortega shim remover is hollow and a light is positioned between members to aid in correct placement and removal of the valve shims.

U.S. Pat. No. 5,980,063 issued to T. D. F. Ford et al. on Nov. 9, 1999, entitled "Illuminated Elongated Tubular Body," discloses a system for emitting light along an elongated tube, or more simply a light stick or wand.

U.S. Pat. No. 6,126,295 issued to G. Hillinger on Oct. 3, 2000, entitled "Fiber Optic Lighting Wrench System for Ratcheting Wrench," discloses a ratchet wrench having a fiber optic bundle therein so that light is transmitted from a light source through the handle via the fiber optic bundles and exits around the work area.

U.S. Pat. No. 6,293,172 issued to J. C. Smith on Sep. 25, 2001, entitled "Telescopic Pocket Door Angle Drill," discloses a telescoping angle drill apparently primarily designed to be used to remove and install pocket door track hardware. The Smith hand tool also includes a light mounted next to the right angle driver on the exterior shell of the tool. Although the Smith patent illustrates generally a light mounted to the exterior surface of a hand tool, such light source is not incorporated into the handle or other portion of the tool.

U.S. Pat. No. 6,318,875 issued to K. Hrabar et al. on Nov. 20, 2001, entitled "Illuminated Nut Driver," discloses a nut driver having a light source located in the handle portion. The light source shines through a longitudinal bore in the tool shaft through an opening in the nut driver on the tip of the shaft. The light illuminates an area adjacent to where a nut is to be placed or removed.

U.S. Pat. No. 6,367,944 issued to L. Wang on Apr. 9, 2002, entitled "Socket Wrench and Light Source Arrangement," discloses a socket wrench having a light mounted in the socket assembly and a battery mounted in the handle so that light is emitted through the open end of the socket.

U.S. Pat. No. 6,379,020 issued to S. E. Lewis et al. on Apr. 30, 2002, entitled "Plumbing Tool," discloses a stopcock tool having a handle portion, a telescoping shaft, and an interchangeable head portion, which may have different arrangements depending upon the intended use of the tool. A clamp is provided on the outside of the shaft for securing a flashlight facing downwardly whereby a work area can be illuminated. The shortcoming of this device is in the inability of a flashlight light beam to illuminate a deep hole as the beam of emitted light will travel only a short distance from the lens of the flashlight.

U.S. Pat. No. 6,454,453 issued to D. Ambrosio on Sep. 24, 2002, entitled "Hand Tool for Driving, and Selectively Illuminating Through, a Conventional Socket," discloses a conventional socket driver having an illuminated fiber optic strand for directing light through the driver's longitudinal central bore.

U.S. Pat. No. 6,478,442 issued to S. Chen on Nov. 12, 2002, entitled "Screwdriver Having a Light Emitting Device," discloses a screwdriver having a light assembly in the handle or gripping portion of the screwdriver and further having a light guiding sleeve surrounding the shank of the screwdriver. Light emitted from the upper end of the handle is transferred along the channel between the sleeve and shank to the tip of the screwdriver.

Although lacking an illumination means, references pertaining generally to pitless well adapters exist in the prior art. For example, U.S. Pat. No. 3,467,181 issued to H. W. Maass on Sep. 16, 1969, entitled "Pitless Well Adapter," discloses an improved adapter arrangement, which is easier to remove and has a simplified construction. Mass illustrates a T-coupling having an internally threaded socket which is threaded to facilitate installation and removal of the pitless adaptor and water pump using a threaded vertical pipe or drop pipe.

U.S. Pat. No. 2,689,611 issued to M. B. Martinson on Sep. 21, 1954, entitled "Means for Extracting the Liquid from a Cased Well Below the Top End of the Casing," discusses the past practice of digging pits adjacent to a well opening, which practice is now discouraged. In Martinson, a "handle" is threaded to the upper opening in the T-coupling or socket member, which is used to lift and lower the well pipe and coupling when it is to be serviced.

U.S. Pat. No. 4,687,056 issued to G. L. Doering on Aug. 17, 1987, entitled "Pitless Adaptor," teaches a modified adaptor wherein the top threaded opening of the pitless adapter is connected to a pipe leading to a yard hydrant, and having a plug which when removed allows water to flow not through the service line but to the hydrant.

Although each may be useful for its particular purposes, none of the aforementioned references teach or disclose an improved pitless adapter lift-out tool that can be more easily attached to a pitless well adapter for use in removing a water pump from a water well, wherein the improvement comprises an integrated illumination means for lighting the interior of a water well casing. Further, the light source in the present invention is connected to the lift-out tool so that it is properly insulated and grounded and will not short circuit upon contact with water and in addition can withstand over time repeated rough use and extended periods of nonuse.

OBJECTS OF THE INVENTION

It is therefore a primary object of the invention to provide a new and improved lift-out device or tool of a type that may be threadably connected to a pitless well adapter assembly in a water well system.

It is a still further primary object of the invention to provide a lift-out device or tool for threadably attaching to a pitless well adapter assembly having an illumination means.

It is a still further object of the invention to provide a lift-out device or tool for attachment to a pitless adapter for a water well system having an integral illumination means whereby said illumination means aids a worker in threadably connecting said to the pitless adapter in an otherwise dark and narrow well casing.

It is a still further object of the invention to provide a lift-out device or tool for attachment to a pitless adapter for a water well system having an integral illumination means whereby said illumination means aids a worker in connecting the tool to said adapter after which the water pump connected via a well pipe to said adapter assembly may be more quickly and easily removed for servicing, and then after servicing is completed the removable portion of the pitless adapter body may be more easily reconnected to the portion permanently secured to the well casing.

It is a still further object of the invention to provide a light in a pitless adapter tool which is protected from damage during use and storage and which will illuminate the field of operations particularly when threading the tool to the pitless adapter as well as when threading is accomplished.

These and other objects and advantages of the invention will become clear upon review of the following detailed description in conjunction with the appended drawings.

SUMMARY OF THE INVENTION

A tool for attachment to and withdrawal of a pitless adapter in a well environment is provided with a light source in the hollow interior of the tool such that the light illuminates the field of operations both when connected to the pitless adapter and such that the light source is protected from shocks and damage both during rough usage of the tool and during storage between uses. The light is cushioned within the tool and multiple openings in the tool are provided for illumination of the field of use.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
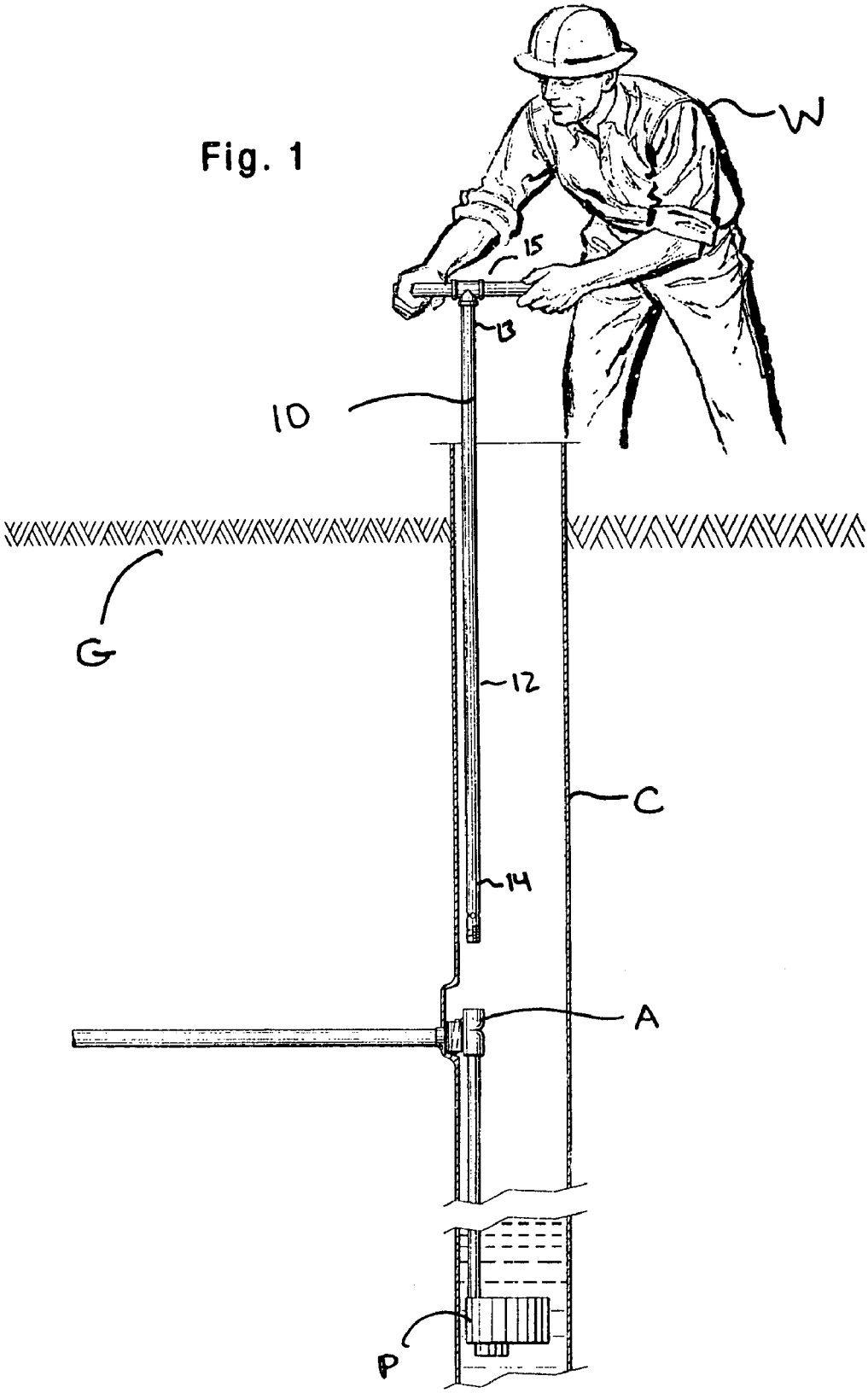
FIG. 1 is a partially sectioned cut away side view of a water well system with the lift-out device of the invention shown being held in close proximity to a pitless adapter.
Figure 3:
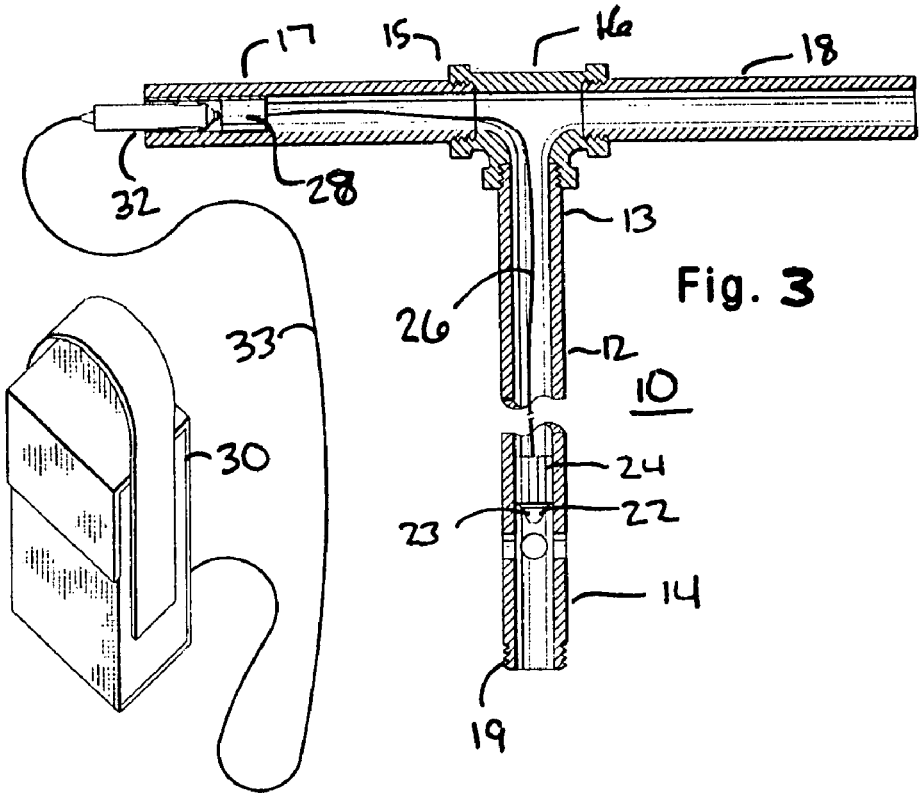
FIG. 3 is a longitudinal sectional view similar to FIG. 2 with but not exactly the same as a power source or pack attached said pitless adapter assembly.
Figure 2:
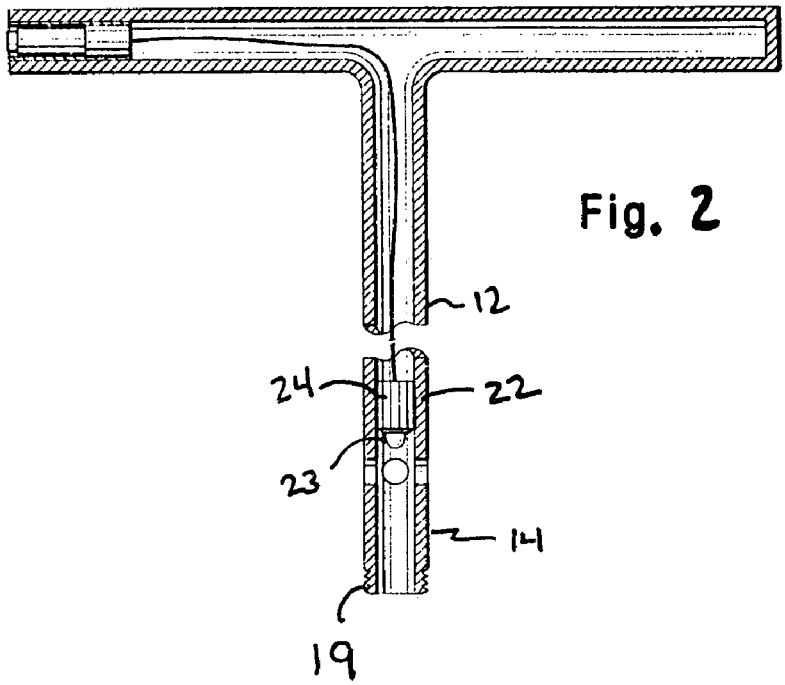
FIG. 2 is a longitudinal sectional view of the pitless adapter lift-out device or tool with the lower end of the lift-out device fore shortened by an intermediate break and showing the light arrangement inside the end.

Referring now to FIG. 1, there is shown a well pump P suspended in well casing C by pitless adapter assembly A connected to a side wall of casing C several feet below ground level G, below the freeze line. Water is pumped upwardly by well pump P and then is diverted horizontally through pitless adapter assembly A and is piped to a home inlet or the like, not shown. Also shown in FIG. 1 is a worker W holding the improved pitless adapter lift-out device 10 of the invention extending downwardly into well casing C. Lift-out device 10 is comprised of an elongated pipe member 12 generally having an upper end 13 and a lower end 14. Typically, elongated pipe member 12 is a one-inch (1") diameter pipe or conduit made of galvanized steel, although it may be made of any suitable conduit material. Connected to upper end 13 of elongated pipe member 12 is handle member 15, which as shown in FIG. 2 is a T-section on the tubular pipe member 12 and in FIG. 3 is comprised of T-joint or fitting 16 threadably connected to upper end 13 of pipe section 12 and horizontal gripping members 17 and 18 which are threadably connected to T-joint or fitting 16 in the usual manner. In FIG. 1, such gripping members, which are also made from one-inch (1") diameter pipes or conduits, are shown gripped by worker W with the device 10 extending into well casing W in a usual manner. Handle member 15 may also be a single piece connected to upper end 13 of elongated pipe member 12, or may be integrally formed with pipe member 12 as shown in FIG. 2. Male threads 19 are provided on lower end 14 of pipe member 12, which threads, as described below, are used to connect the lift-out device 10 to the adapter body portion of pitless adapter assembly A. Pipe member 12 may vary in length but as shown in FIG. 1 should be at least long enough so that threads 19 on lower end 14 of pipe member 12 reach pitless adapter A with handle member 15 protruding several inches out of the top of well casing C. For example, in colder climates, pitless adapter A typically will be at least three or four feet below the ground surface, below the freezing line for such climate, while in a warmer climate the adapter may be closer to the surface.

Referring still to FIG. 2 and also now to FIG. 3, light source 22 is secured in elongated pipe member 12 near lower end 14, near or just above threads 19. Light source 22 is shown as a small diameter bulb 23 mounted in socket or plug 24. A particular problem encountered during development of the invention was that in mounting socket or plug 24 in pipe member 12, due to the rugged ordinary method of use plus treatment of lift-out device 10, bulb 23 tended to break or become loose easily and be inoperable. Therefore, it is preferred that socket or plug 24 be comprised at least partly of a rubber material to help cushion the device from shocks encountered during both actual use and storage between uses. In other words, not only may the tool be bumped against the sides of the well and subjected to shocks during use, but it may be laid roughly in the back of a truck or laid roughly on the ground or in an unpadded rack between uses, causing a high incidence of breakage of not only the bulb but also the filament within the bulb. For the same reason it is desirable to use a shock resistant bulb such as, for example, a halogen bulb. A bolt or screw extending laterally through pipe member 12 (not shown) may also be used to secure light source 22 in position. The light source also should not be positioned too near the end of the tool so that it is further protected from physical damage. If a screw, bolt or other such fastening is used to aid in holding the socket in place, it is desirable that such fastening also be insulated from shock such as by having a rubber or other resilient material sleeve around the fastening or on the surface of the fastening.

Wire 26 is connected to light source 22 on one end and extends upwardly through the hollow interior of pipe member 12, through T-joint 16, and into gripping member 17, where it is connected on its other end to female plug 28 mounted securely in such gripping member 17. As shown in FIG. 3, a portable external battery pack 30 having male plug 32 on the end of wire 33 is also provided. Male plug 32 fits in female plug 28 secured in gripping member 17 and establishes a connection between battery pack 30 and light source 22. Male plug 32 is preferably of a type that fits in a standard vehicle cigarette lighter, with battery pack 30 in addition being rechargeable. A switch for turning light source 22 on and off, not shown, may also be provided. Alternatively, the battery pack may be replaced by a standard connection for an automobile cigarette lighter in order to power the preferably 12 volt light. It is appropriate that the battery pack also be 12 volt in view of the wet conditions in which the light is used.

Figure 4:
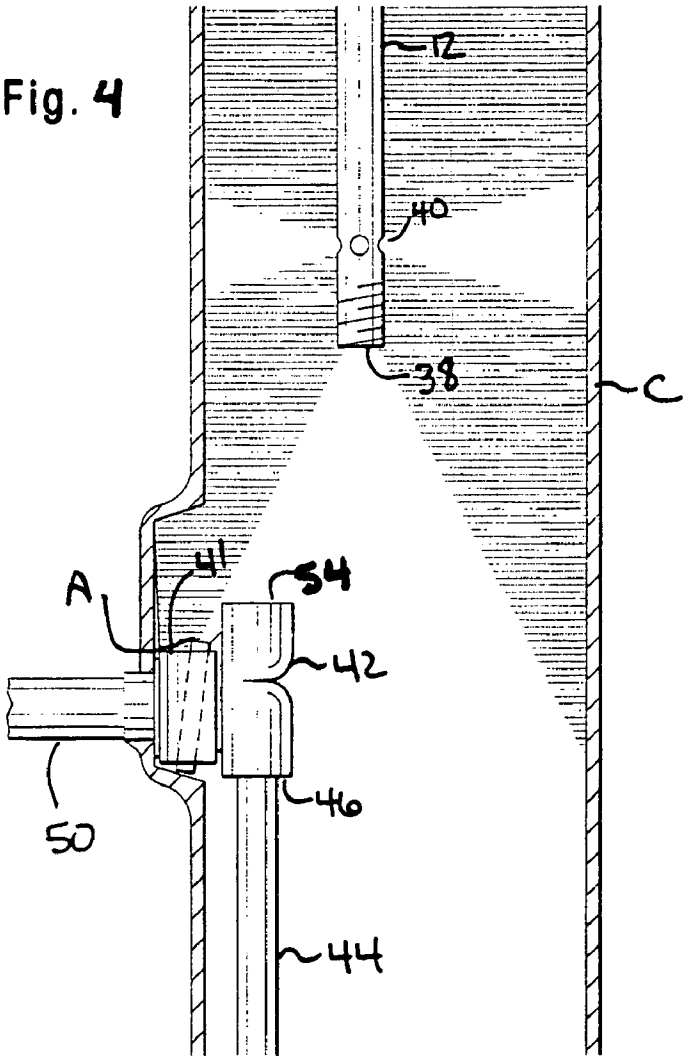
FIG. 4 is a partial sectional view of a well containing a pitless adapter the lighted tool of the invention approaching the pitless adapter showing the illumination provided by the light source.

Referring now to FIG. 4, light source 22 is mounted in hollow pipe member 12 so that the light beams (shown by the white or unshaded area in casing C in FIGS. 4 and 5; the unlighted portion of casing C being shown by the shaded areas) are directed generally downwardly through opening 38 in lower end 14 of pipe member 12. In addition, apertures 40, of which there may be one or more and preferably are at least two on opposite sides of pipe member 12, are provided in lower end 14 of pipe member 12 directly adjacent light source 22 so that light is also laterally directed through such apertures 40 to illuminate a larger portion of well casing C.

Figure 5:
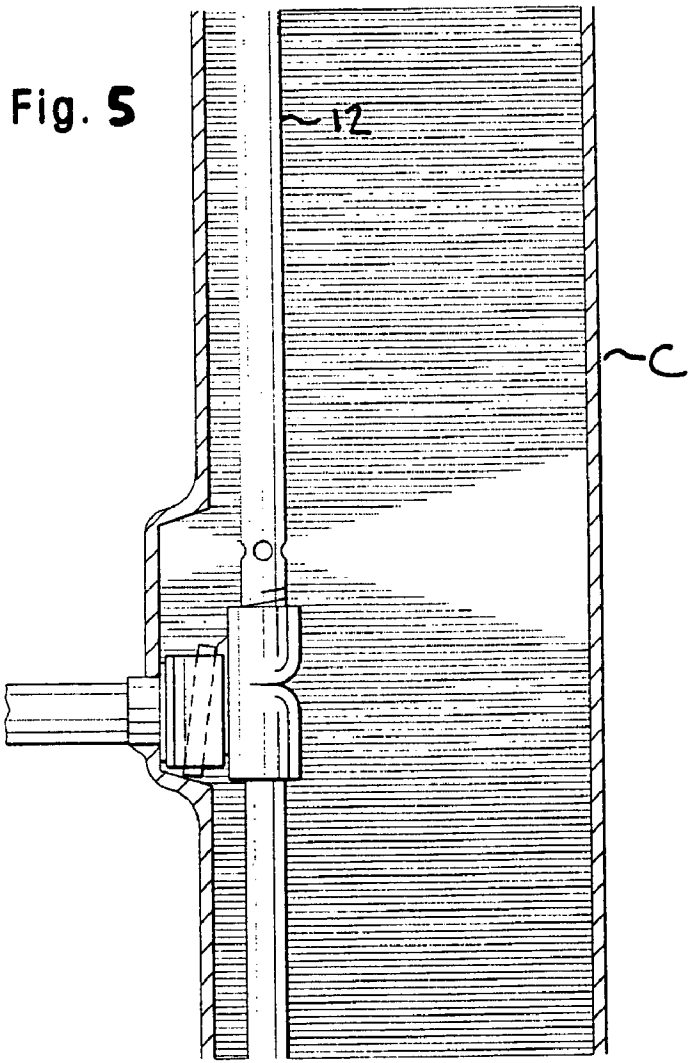
FIG. 5 is a partial sectional view similar to FIG. 4 with the lighted tool connected to the pitless adapter by being threaded into the upper connection.

FIGS. 4 and 5 further illustrate how lift-aid device 10 may be typically used. In FIG. 4, a portion of well casing C is shown, with pitless adapter A having a first portion 41 permanently connected to the wall of well casing C, as well as adapter body portion 42 which is detachably and slideably connected to first portion 41 as well known in the art, the interfitting being secure enough usually as the result of the weight of the well pipe and pump drawing the two connecting pieces close together in a wedging sealing relationship, to prevent any major escape of fluid through the seal between the two parts. Vertical well pipe 44 is connected extending downwardly from socket 46 in adapter body portion 42 of pitless adapter A, to which pipe well pump P is connected at its lower end, as shown in FIG. 1. In addition, horizontal well pipe 50 is connected in socket member 52 on first portion 41 of pitless adapter A so that water pumped out of the well travels up vertical well pipe 44, through pitless adapter A, and then through horizontal well pipe 50 to a residence or the like. A third socket member 54 having female threads is provided on the top side of adapter body portion 42 of pitless adapter A for receiving the threaded lower end 14 of lift-aid device 10 of the invention. However, as one can imagine, due to the narrowness and darkness of the well casing C, even with the well casing cap removed, very little light shines down into such casing C far enough to reach socket member 54 on pitless adapter A, so that such adapter and threads are essentially invisible to the naked eye. Although after a few minutes the worker W's eyes may gradually adjust somewhat to the darkness, it is still very difficult to properly align the threads 19 on the lower end 14 of lift-out device 10 with threaded socket member 54 on pitless adapter A, even though over time worker W will learn through trial and error approximately where such adapter might be located. Furthermore, while, if worker W holds a flashlight in one hand pointed into well casing W, visibility might be somewhat improved, it is still significantly more difficult to control lift-out device 10 with one hand than with two. It would also be difficult to have a second worker hold a flashlight pointed into well casing W, as there is little room due to the narrowness of casing C. However, as shown in FIG. 4, by mounting light source 22 just above threads 19 in pipe member 12 as described, pitless adapter A and socket member 54 are illuminated and readily visible, and threading lift-out device 10 to pitless adapter A, as shown in FIG. 5, becomes a relatively simple matter. Once lift-out handle 10 is properly threaded into socket 54, the adapter body portion 42 of pitless adapter A, along with water pump P situated on the lower end of vertical pipe 44, can be easily pulled upwardly out of well casing C for servicing or the like. Furthermore, when it is time to reinstall water pump P by lowering it back into well casing C using lift-out handle 10, light from the light source 22, although blocked from being emitted from the lower end 38 of the device 10 by adapter A, emanates through apertures 40 in pipe member 12 so as to aid in lining up and reattaching the adapter body portion 42 of pitless adapter A to the first portion 41 permanently connected to the side of well casing C. The possibility of the pitless adapter A being damaged by inadvertently banging it into the side of the well casing C in attempting to align it with such permanently connected portion is also minimized. In addition, there is less chance that the water pump P will be damaged due bumping or smashing into the side of well casing C during reinstallation.

While the basic invention has been described above, it may contain or embody further alternative arrangements and embodiments while still falling within the scope of the invention. For example, handle member 15 may be folding or telescoping for storage purpose, while elongated pipe member 12 may also be telescoping if desired. In addition, while the battery source for the invention is preferably provided as an external battery pack connectable to a socket mounted in the handle portion of the invention, a battery chamber may also be provided directly in said handle section or elongated pipe member section of the invention, which batteries may or may not be rechargeable. In addition, a separate connector may be provided on the lower end of the device for threadably connecting to the pitless adapter assembly, although it is believed that placing the threads on the exterior of the pipe member is probably a more practical and structurally sound arrangement. It may also be possible to manufacture the pipe member or a portion of the pipe member using a translucent structural plastic material, such that the light may emanate directly through the walls of the pipe member rather than through apertures in the pipe member. In such way the light may be further protected from exterior damage, although then the pipe member itself may not be as durable.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A lift-out device for connecting to a pitless adapter in a water well assembly comprising an elongated tubular member having a first end and an open second end, a handle means connected to said first end, threads provided on the outer surface of the second end for threadably connecting with matching threads on said pitless adapter, and a light source fixedly mounted within the elongated tubular member near the second end in a position such that rays of light emanate from the end downwardly during use.

2. A lift-out device for connection to a pitless adapter assembly as provided in claim 1 additionally comprising one or more apertures provided in said elongated tubular section adjacent the light source to allow for projection of light laterally outwardly through said apertures.

3. A lift-out device for connection to a pitless adapter assembly as provided in claim 1 additionally comprising an external power source electrically connected to said light source for providing electrical power to said light source.

4. A lift-out device for connection to a pitless adapter assembly as provided in claim 3 additionally comprising a socket member mounted in the handle portion of said device for detachably connecting said external power source to said light source.

5. A lift-out device for connection to a pitless adapter assembly as provided in claim 4 wherein said external power source is a rechargeable battery pack.

6. A lift-out device for connection with a pitless adapter assembly as provided in claim 4 wherein the socket member is secured in the elongated tubular member with an intermediate resilient medium providing shock resistance.

7. A lift-out device for connection with a pitless adapter assembly as provided in claim 4 wherein the socket member is secured in the elongated tubular member by a piercing type fastening which is itself cushioned by a resilient material.

8. A lift-out device for connection with a pitless adapter assembly as provided in claim 1 whereby said light source is comprised of a bulb contained in the second of said elongated tubular member, an electrical socket for said bulb, and a power source for the bulb.

9. A lift-out device for connection with a pitless adapter assembly as provided in claim 8 wherein the socket contains a halogen bulb.

10. A lift-out device for connection with a pitless adapter assembly as provided in claim 1 wherein said handle and elongated tubular member are a continuous member.

* * * * *